United States Patent [19]

Warren et al.

[11] Patent Number: 4,778,042

[45] Date of Patent: Oct. 18, 1988

[54] VENDING MACHINE

[75] Inventors: Peter A. Warren, Beecroft; Evelyn A. Shervington, Birchgrove; Ian S. Fitzpatrick, Victoria, all of Australia

[73] Assignee: The Commonwealth Industrial Gases Limited, Surry Hills, Australia

[21] Appl. No.: 928,000

[22] Filed: Nov. 7, 1986

[30] Foreign Application Priority Data

Nov. 15, 1985 [AU] Australia ..... PH3429

[51] Int. Cl.[4] ..... G07F 7/06; G07F 11/58

[52] U.S. Cl. ..... 194/212; 221/78

[58] Field of Search ..... 194/205, 208, 209, 211-213; 221/77-86, 88, 66; 222/87; 141/3, 18, 20

[56] References Cited

U.S. PATENT DOCUMENTS

| | | | |
|---|---|---|---|
| 1,530,288 | 3/1925 | Balkema | 221/66 X |
| 1,820,671 | 8/1931 | McCormick et al. | 221/81 X |
| 3,062,405 | 11/1962 | LeBlanc | 221/77 |

FOREIGN PATENT DOCUMENTS

| | | | |
|---|---|---|---|
| 2554263 | 5/1985 | France . | |
| 2557332 | 6/1985 | France . | |
| 938050 | 9/1963 | United Kingdom | 221/86 |

*Primary Examiner*—F. J. Bartuska

*Attorney, Agent, or Firm*—Beveridge, DeGrandi & Weilacher

[57] ABSTRACT

A coin-freed vending machine for cylinders of compressed gas comprises an outer cabinet having a door-opening, a storage chain conveyor for cylinders within the cabinet and a rotatable transfer cradle between the door-opening and the conveyor preventing access to the conveyor. The transfer cradle is furnished with sensors enabling an empty cylinder placed in it through the door-opening to be identified by a data processor, following which the cradle and conveyor are operated to load the empty cylinder into the conveyor and to unload a full cylinder from the conveyor for extraction through the door-opening.

22 Claims, 5 Drawing Sheets

VENDING MACHINE

This invention relates to coin or token freed vending machines of the kind which require a returnable empty container to be put into the machine before it may be operated to deliver a replacement full container.

The invention was devised for the vending of cylinders of compressed gas. Such cylinders are usually more valuable than the gas they contain and so it is very important commercially that a sale is effected only when a genuine cylinder is presented to the machine by a prospective purchaser.

A further and more important reason for care in monitoring the genuineness of the empty cylinder arises because gases of differnt kinds are sold in cylinders which differ only to a slight extent, often only in the details of the cylinder valve. Thus, there is a risk that a purchaser acting in good faith and wishing to purchase, say, carbon dioxide may present an empty cylinder for that gas, to a machine, or machine section selling, say, butane. Unless the butane machine rejects the carbon dioxide cylinder with certainty and refuses to dispense a cylinder of butane in exchange for it, the purchaser ma mistakenly accept the butane for carbon dioxide with possibly disastrous consequences when later attempting to use the gas.

Therefore it is an object of the invention to provide a coin or token freed vending machine for cylinders of compressed gas which before dispensing a full cylinder of gas must receive an identical cylinder with an identical valve.

The only prior proposal for a gas cylinder vending machine of which we are aware is that of French patent application No. 83 17051 now Pat. No. 2 554 263 . In that case there is virtually no check on the nature of the empty cylinder and none whatsoever o the nature of its valve. Indeed it would seem that any object of approximately the same size and weight as the relevant empty cylinder would free the machine for a dispensing operation.

Another item of relevant prior art is French patent application No. 83 20757 now Pat. No. 2 557 332. This discloses an empty bottle accepting apparatus including a sensing arrangement which is responsive to the profile shape of a bottle's neck and shoulders. The apparatus includes a data processor which compares the sensing arrangement's output with a memorised standard and controls the operation of the apparatus in a way depending on the closeness of the comparison.

This invention consists in a coin, card, key or token freed vending machine for valved cylinders of compressed gas comprising a supporting structure having a front panel with a door opening therein, a storage conveyor adapted to hold a gas cylinder in each of a plurality of locations in an equally spaced sequence of locations, conveyor drive means which each time they are actuated drive said conveyor an incremental distance equal to the spacing between two locations, a transfer cradle shaped to snugly receive and locate a valved gas cylinder of predetermined shape and dimensions and disposed intermediate said door opening and off and on loading stations for said conveyor, cradle drive means which each time they are actuated shift said cradle from a rest position in which it may accept an empty cylinder through said door opening to a first operative position in which it discharges the empty cylinder onto said conveyor then to a second operative position, in which it accepts a full cylinder discharged from said conveyor, and then back to its rest position, a plurality of sensor means each adapted to issue an electric signal when a predetermined condition is sensed, at least some plurality of said sensor means being associated with said cradle and being respectively responsive to characteristics of a cylinder and its valve if present in said cradle, and a data processor receiving the signals from the sensor means and issuing a control signal or signals if the received signals comply with a signal profile held in the memory of the processor, which control signal or signals causes an actuation of the machine.

In preferred embodiments the processor controls a visual display panel on the front of the machine, which informs the user of the machine's status and prompts him in respect of any actions he must take to effect the transaction required.

By way of example an embodiment of the above described invention is described in more detail below with reference to the accompanying drawings.

The illustrated embodiment comprises a cabinet 7 with an internal framework (not shown) housing and supporting the remaining components of the machine. The cabinet 7 has a front panel 8 with an access doorway therethrough, which is normally closed provided with a door 9.

Figure 1:
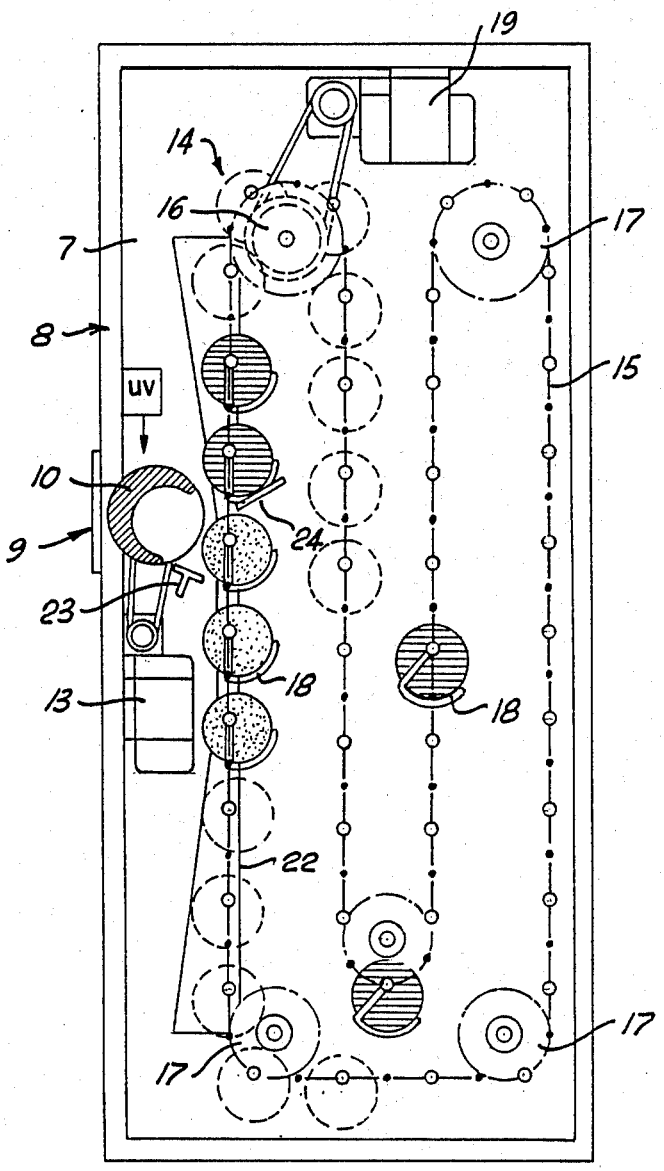
FIG. 1 is a diagrammatic side elevation of a vending machine or machine section according to the invention.

The subject matter of FIG. 1 may be the whole of a machine dedicated to the supply of a single product. More usually it is a section of a multi-product machine in which each section may hold and dispense differing products.

Thus a number of transactions are possible depending on what product is sought and whether or not the prospective purchaser has an empty container to return.

Therefore a prospective purchaser firstly indicates the nature of the transaction he wishes to make by, for example, operating a push-button key-pad 30 or the like. The signals so generated by the purchaser are fed to a data processor 31 which thereafter ensures that subsequent operations are in accord with that requirement.

The cabinet 7 houses coin monitoring devices 34 of conventional kind having coin inlet slots 32 in the front panel 8. Upon the coin monitoring device receiving the amount appropriate to the type of transaction involved it signals the data processor 31 controlling the operation of the machine as a whole.

If the transaction is one involving the return of an empty cylinder the processor energises a solenoid (not shown), which unlocks door 9 and initiates a motor (not shown) to open it and awaits further input signals before proceeding further. If the transaction is one not involving the return of an empty cylinder the processor proceeds directly with a dispensing operation as described below with reference to the first mentioned type of transaction.

When the door 9 opens the customer is presented with an empty cylinder transfer cradle 10 ready to receive an empty cylinder E.

Figure 2:
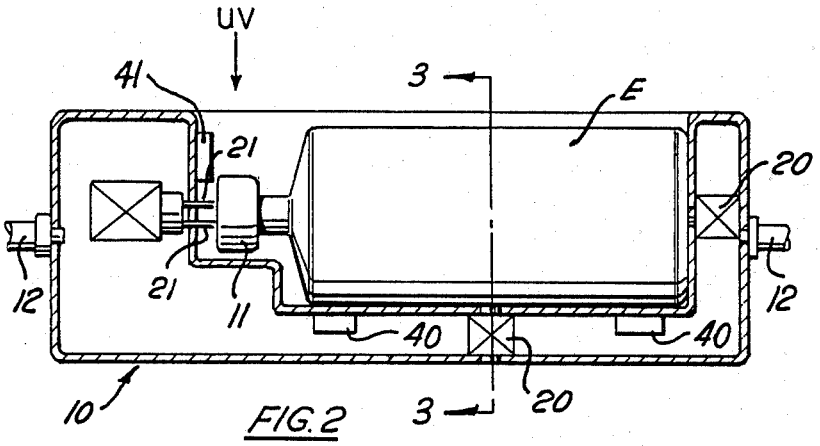
FIG. 2 is longitudinal sectional view of a transfer cradle being a component of the machine of FIG. 1 drawn to a larger scale shown holding a gas cylinder.
Figure 4:
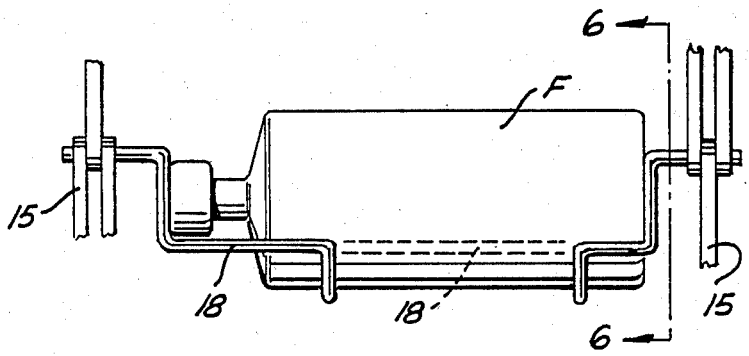
FIG. 4 is a side elevation of a conveyor carrier being a component of the machine of FIG. 1 drawn to a larger scale shown holding a gas cylinder.
Figure 3:
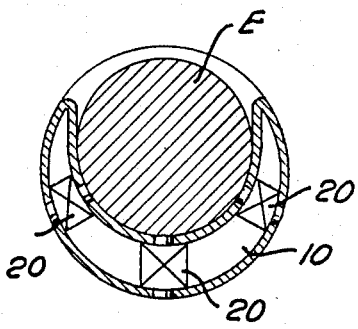
FIG. 3 is a sectional view taken on line III—III of FIG. 2.

The transfer cradle 10 has a recess to accomodate the cylinder E which, as may best be seen in FIG. 2, is shaped as a snug fit about the cylinder including such a fit about the neck and valve 11 of the cylinder. Thus any cylinder or other article which is substantially different from the correct cylinder and which may be presented by the customer would either not enter the recess or would incompletely fill it.

The cradle 10 is preferably a hollow moulding of a durable and tough plastics material and is mounted for rotation about axles 12 under the influence of geared motor 13. The arrangement is such that when the motor 13 is actuated the cradle 10 is rotated one-half revolution, reversing the motor then returns the cradle to its starting position.

The cradle 10 effectively blocks access to the interior of the cabinet 7 and in particular to a chain conveyor 14 therein.

The conveyor 14 comprises a pair of endless chains 15 trained around paired drive wheels 16 and idler wheels 17 so as to follow a pair of spaced apart, mutually parallel, tortuous paths and a plurality of cylinder carriers 18 bridging from chain to chain and suspended therefrom. The carriers 18 are equally spaced apart along the chains 15.

The conveyor 14 is driven by a second motor 19 connected to the drive wheels 16. The arrangement is such that each time the motor 19 is actuated the conveyor chains are advanced by a distance equal to the spacing between adjacent carriers 18.

A plurality of proximity sensors 20 are disposed within the cradle 10. Those sensors may be conventional commercially available items. They are essentially switches which close whenever an object comes into close proximity with the end of the sensor. Thus all of the sensors respond if a body of the same shape and size as the relevant cylinder is placed in the cradle 10, but at least one of the sensors 20 would be unaffected if an over- or under-sized body were to be presented.

A further plurality of proximity sensors 21 are clustered at one end of the cradle 10, being the end adapted neatly to accommodate the valve 11 of a cylinder E. The sensitive faces of sensors 21 are positioned so that all of the sensors 21 respond when and only when a cylinder with a correctly shaped valve is ensconced in the cradle 10.

For preference there are magnetically operated sensors 40 in the cradle 10 which determine whether the cylinder E and valve is a steel or a non-ferrous material and signals accordingly.

Also there may be an optical sensor 41 responsive to the fluorescence of a plastics cap, when illuminated by ultraviolet light, trained on the cylinder immediately upstream of the cradle 10 on the conveyor 14 to check that that cylinder has such a cap and therefore is indeed a full cylinder. The caps in question are applied to cylinders as they are factory filled and are necessarily destroyed by the consumer when first taking gas from a cylinder.

Signals from all the sensors are fed to the data processor and if everything is consistent with a genuine cylinder having been placed in the cradle after coins appropriate to a full for empty type transaction have been received or with an empty cradle if coins appropriate to an initial purchase of a full cylinder have been received the processor issues control signals to actuate the motors 13 and 19. There may be a slight time delay between the actuation of the motors, or their effective driving speeds may vary so that effective synchronisation of their operations occurs or the progress of motor 19 may be made contingent on that of motor 13. In any event the issuance of the go signal causes the sequence of events illustrated by FIGS. 5A to 5E to occur.

Figure 6:
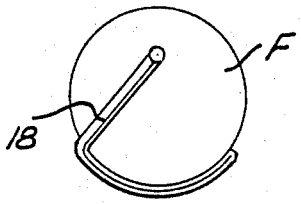
FIG. 6 is a sectional view taken on line VI—VI of FIG. 4.
Figure 5B:
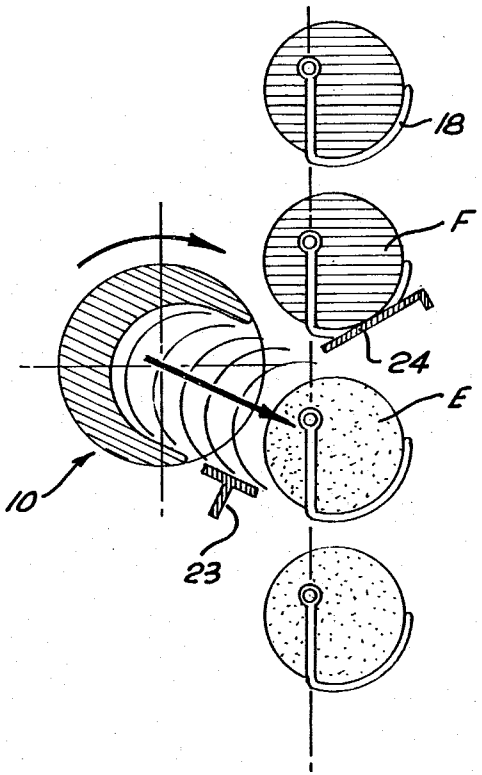
FIGS. 5A to 5E are diagrams showing successive stages in the operation of the machine of FIG. 1.
Figure 5A:
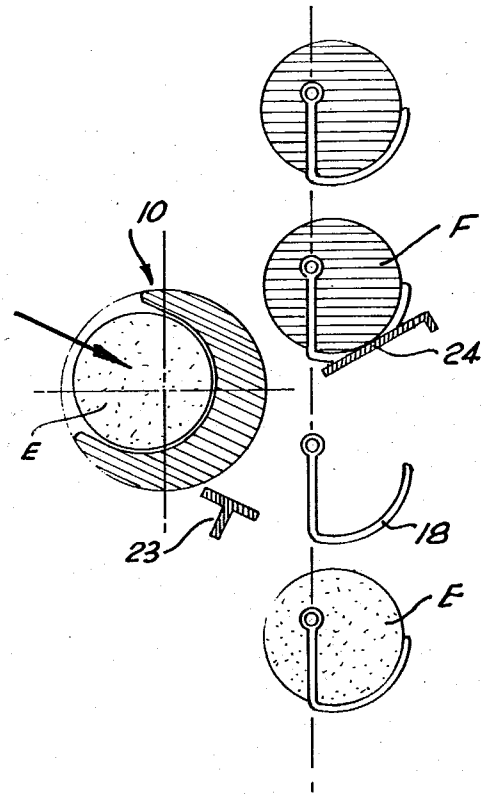

In FIG. 5A an empty cylinder E has been placed in the cradle 10. A full cylinder F is held by a carrier 18 in an off loading station adjacent and slightly above the cradle. An empty carrier 18 is disposed in an on loading station also adjacent the cradle but slightly below it. It will be noted that the carriers in FIG. 5A have been turned somewhat from their freely hanging position as shown for example in FIG. 6. That turning is due to engagement of the carriers 18 descending past the cradle 10 with appropriate guides 22 and is to facilitate the movement of cylinders into and out of the carriers in the on and off loading stations.

In FIG. 5B the cradle has been turned clockwise by a half revolution and the empty cylinder E rolls from the cradle 10 across a support 23 into the formerly empty carrier 18.

Figure 5E:
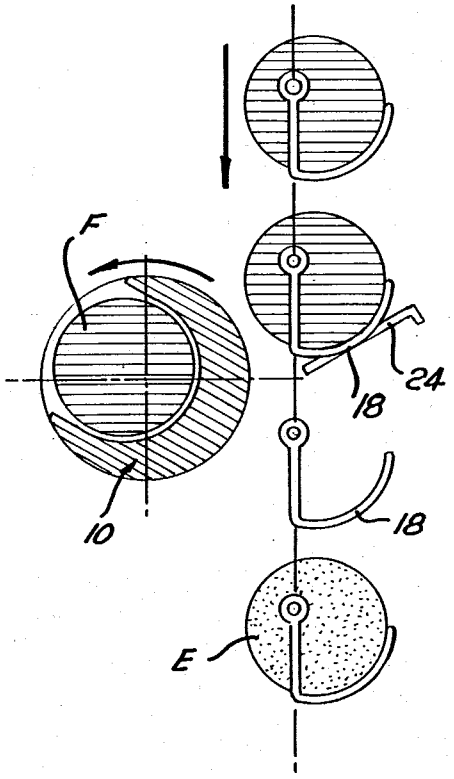
Figure 5D:
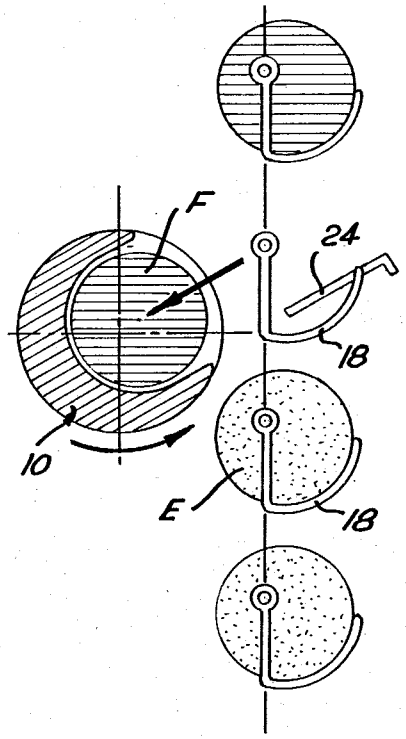
Figure 5C:
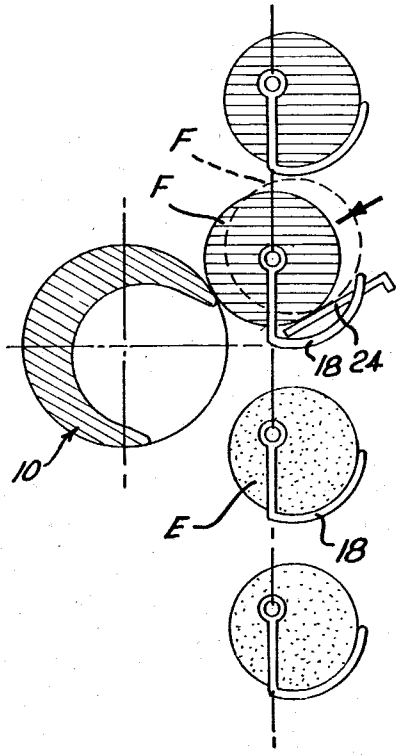
Figure 7:
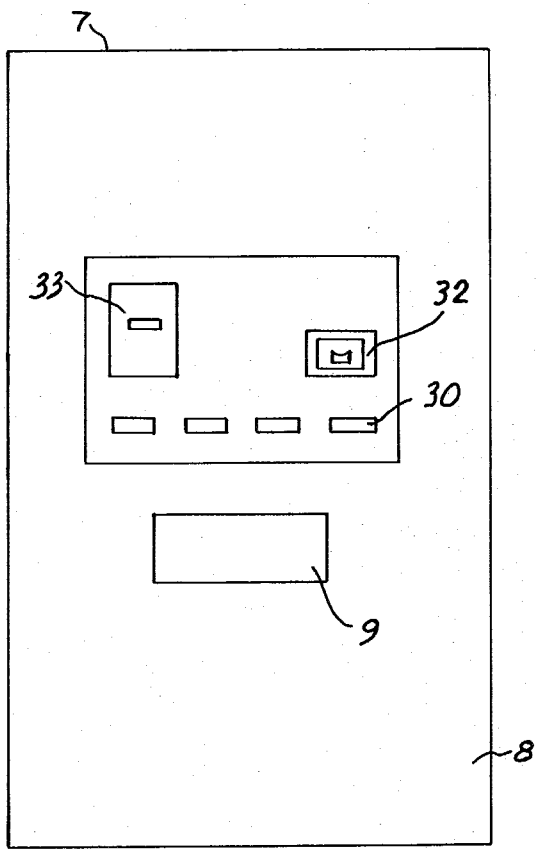
FIG. 7 is a front elevation of a vending machine according to the invention.
Figure 8:
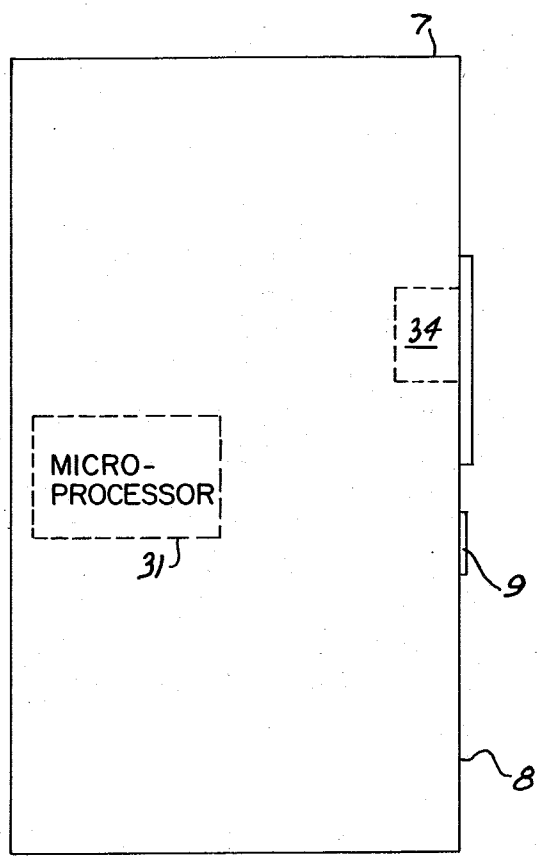
FIG. 8 is a side elevation of a vending machine according to the invention.

In FIG. 5C the conveyor 14 has been actuated and the flight adjacent the cradle 10 moved downwardly to cause full cylinder F to be forced by a fixed arm 24 from its carrier 18 to rest upon the arm 24 and the outer surface of the cradle.

In FIG. 5D the cradle 10 has returned part way back to its starting position and the full cylinder has thereby rolled from the arm 24 into the cradle recess.

In FIG. 5E the cradle 10 has returned and the full cylinder in it may be removed by the customer when the door opens. At the same time the conveyor 14 has finished its incremental movement so that another carrier 18 holding another full cylinder is in the off loading station and previously filled but now empty carrier has moved into the on loading station. Once the full cylinder has been removed by the customer the door 9 closes as instructed by the processor and the machine is reset for another vending operation.

The data processor may also be conditioned to respond to a magnetically encoded credit card or the like 33 in lieu of coins. It may also be responsive to a similar input to adopt a loading mode in which it permits repeated operation or operation of the conveyor 14 only to enable the machine to be emptied of empty cylinders and recharged with full cylinders by an operator.

In other embodiments of the invention the sensors 20 and 21 may be supplemented or even replaced by other conventional sensor means, for example optical sensors responsive to identifying indicia such as a bar code applied to the cylinders or to the cylinder colour.

We claim:

1. A vending machine for valved cylinders of compressed gas comprising a supporting structure having a front panel with a door opening therein, a storage conveyor adapted to hold a gas cylinder in each of a plurality of locations in an equally spaced sequence of locations, conveyor drive means which each time they are actuated drive said conveyor an incremental distance equal to the spacing between two locations, a transfer cradle shaped to snugly receive and locate a valved gas cylinder of predetermined shape and dimensions and disposed intermediate said door opening and off and on loading stations for said conveyor, cradle drive means which each time they are actuated shift said cradle from a rest position in which it may accept an empty cylinder through said door opening to a first operative position in which it discharges the empty cylinder onto said conveyor then to a second operative position in which it accepts a full cylinder discharged from said conveyor and then back to its rest position, a plurality of sensor means each adapted to issue an electric signal when a predetermined condition is sensed, at least some plurality of said sensor means being associated with said cradle and being respectively responsive to characteristics of a cylinder and its valve if present in said cradle, and a data processor receiving the signals from the sensor means and issuing a control signal or signals if the received signals comply with a signal profile held in the memory of the processor, which control signal or signals causes an actuation of the machine.

2. A machine according to claim 1 wherein said characteristics include the material of which the cylinder and valve is made.

3. A machine according to claim 2 wherein said characteristics include the shape and dimensions of the cylinder or valve.

4. A machine according to claim 1 housing customer operable input means, whereby a customer may indicate the kind of transaction required and the processor then selects a corresponding signal profile.

5. A vending machine according to claim 1, wherein said storage conveyor is a tortuous chain conveyor

6. A vending machine according to claim 1, wherein said cradle is a hollow plastics moulding and wherein said sensor means comprises proximity sensors within the hollow interior of said moulding.

7. A vending machine according to claim 1, wherein said sensor means include a sensor responsive to a plastics cap on a cylinder about to be dispensed to check that it is a full cylinder.

8. A vending machine for containers, comprising:

an essentially enclosed supporting structure having a front panel with a door opening formed therein;

conveying means for transferring a plurality of the containers, said conveying means located within the interior of said supporting structure and including a pair of endless chains, first driving means for driving said pair of endless chains and a plurality of carriers each adapted to support one of the containers, each of said carriers having a first end pivotably attached to one of said pair of endless chains and a second end pivotably attached to the other of said pair of endless chains, said conveying means also including an upper and a lower pair of idler wheels in contact with said pair of endless chains and positioned so as to have a portion of said pair of endless chains extending essentially parallel and in close proximity to said front panel;

an inclined arm member fixedly supported by said supporting structure and positioned between said upper and lower pair of idler wheels and further from the front panel than is that portion of said pair of endless chains extending essentially parallel to said front panel;

an inclined support ramp fixedly secured to said supporting structure and positioned below said arm and closer to the front panel than is that portion of said pair of endless chains extending essentially parallel to said front panel;

a transfer cradle pivotably supported by said supporting structure and positioned so as to have its axis of rotation extending essentially parallel to said front panel and closer to said front panel than is said inclined support ramp, said transfer cradle adapted to releasably support one of the containers;

second driving means for rotating said transfer cradle to a first position in which a container is accessible from the door opening, to a second position in which said cradle is adapted to release a container onto said support ramp and to a third position in which said cradle is adapted to receive a container supported on said inclined arm member.

9. A machine according to claim 8 wherein said containers are cylinders of compressed gas.

10. A machine according to claim 8 wherein said transfer cradle includes a plurality of sensing means for issuing electrical signals in accordance with the characterisitics of a container supported by said transfer cradle.

11. A vending machine which requires the return of an empty container before the issuance of a full container, comprising:

a supporting structure having an interior and a front panel with a door opening formed therein carrier means for supporting a plurality of containers within said supporting structure;

first driving means for inducing motion to said carrier means;

a transfer cradle pivotably supported by said supporting structure and having a container holding area formed therein, an inclined arm member fixedly supported to said supporting structure;

a ramp member fixedly supported to said supporting structure;

a second driving means for rotating said transfer cradle to a first position in which a container is accessible from the door opening, to a second position in which said cradle is positioned to release a container onto said support member and to a third position in which said cradle is positioned to receive a container supported by said inclined arm member.

12. A machine according to claim 11 wherein said containers are cylinders of compressed gas.

13. A machine according to claim 12 further comprising a plurality of sensor means for issuing electrical signals in accordance with the characteristics of a container supported by said transfer cradle.

14. A machine according to claim 13 further comprising a purchaser indication means for issuing electrical signals in accordance with a purchasers indication as to what type of full container is desired.

15. A machine according to claim 14 further comprising a microprocessor which receives the electrical signals from said sensor means and said indication means and compares the two electrical signals to insure that the received electrical signals comply with a signal profile held in the memory of said microprocessor.

16. A machine according to claim 15 further comprising a coin inlet slot and a coin monitoring device said coin monitoring device issuing signals to said microprocessor whereby said microprocessor evaluates the signal and actuates said vending machine if the signals correspond to a signal profile held in memory.

17. A machine according to claim 13, wherein at least one of said sensor means includes a magnetically operated sensor adapted to differentiate between a ferrous material and a nonferrous material and signal accordingly.

18. A machine according to claim 13 wherein at least one of said sensor means includes an optical sensor responsive to the fluorescence of a plastic material when illuminated by an ultra violet light.

19. A machine according to claim 13 wherein said transfer cradle is a hollow plastics molding and wherein said sensor means includes at least one proximity sensor secured within the hollow interior of said molding.

20. A machine according to claim 11 wherein said first driving means includes a motor, drive gearing, and a pair of endless chains.

21. A machine according to claim 20 wherein said pair of endless chains travel in a tortuous path and said carriers are attached to said pair of endless chains so that each of said carriers is spaced equally from one another.

22. A machine according to claim 21 wherein said driving motor, upon each activation, drives said pair of endless chains an incremental distance equal to the spacing between two adjacent carriers.

* * * * *